United States Patent [19]

Habermehl et al.

[11] 4,380,125

[45] Apr. 19, 1983

[54] METHOD OF AND APPARATUS FOR DRYING AND PREHEATING COKING COAL IN A FLIGHT STREAM TUBE

[75] Inventors: Diethard Habermehl; Wolfgang Rohde; Werner Kucharzyk; Werner Siebert, all of Essen, Fed. Rep. of Germany

[73] Assignees: Bergwerksverband GmbH; Didier Engineerin GmbH, both of Essen, Fed. Rep. of Germany

[21] Appl. No.: 199,953

[22] Filed: Oct. 23, 1980

[30] Foreign Application Priority Data

Oct. 24, 1979 [DE] Fed. Rep. of Germany ..... 2942878

[51] Int. Cl.[3] ..... F26B 3/10; F26B 17/10

[52] U.S. Cl. ..... 34/10; 34/57 R; 432/15; 432/58; 209/143

[58] Field of Search ..... 432/15, 58; 34/10, 57 R, 34/57 A; 209/143

[56] References Cited

U.S. PATENT DOCUMENTS

| | | | |
|---|---|---|---|
| 3,049,343 | 8/1962 | Helming | 432/58 |
| 4,249,892 | 2/1981 | Brachthauser et al. | 432/58 |
| 4,270,900 | 6/1981 | Shy et al. | 432/58 |
| 4,276,020 | 6/1981 | Shibuya et al. | 432/58 |
| 4,299,564 | 11/1981 | Herchenbach | 432/58 |

*Primary Examiner*—Larry I. Schwartz

*Attorney, Agent, or Firm*—Michael J. Striker

[57] ABSTRACT

A method and an apparatus are disclosed for drying and preheating coking coal particles of mixed sizes in a flight stream tube. A stream of hot gas in which different-size particle fractions are entrained, is advanced through the tube. At one or more locations it is split up into two flows, one containing the smaller fractions and the other containing the coarser fractions. The coarser fractions are slowed and readmitted into the flow having the smaller fractions, counter to the direction of advancement of this flow.

12 Claims, 3 Drawing Figures

METHOD OF AND APPARATUS FOR DRYING AND PREHEATING COKING COAL IN A FLIGHT STREAM TUBE

BACKGROUND OF THE INVENTION

The present invention relates to the drying and preheating of particulate (usually granular or pulverulent) coking coal.

For reasons known to those skilled in the art, coke is being made more and more often from comminuted coal which, after comminution, is available as a mix of different-size fractions and in moist condition. The comminuted coking coal must be dried; moreover, it has been found that coking conditions can be improved if the coal is furnished to the coking ovens not only in dry condition but in positively preheated condition.

Equipment for effecting such drying and preheating is known, in form of single-stage but usually dual-stage flight stream tubes. These are upright tubes into the lower end of which a stream of hot carrier gas is admitted, in which the coal particles to be dried and heated are entrained. The carrier gas is usually produced in a combustion chamber and mixed with recirculated vapors. The stream issues from the upper end of the flight stream tube and passes through one or more cyclones in which the carrier gas is separated from the coal particles.

The moisture to be expelled from the coal particles usually amounts to about 10% by weight and the subsequent preheating of the coal particles is desired to a temperature of about 200° C. These requirements, especially the preheating, could previously be met in a single-stage flight stream tube only on condition that the incoming carrier gas was very hot (disadvantageous, because it adversely influences later coking characteristics of the coal) and that the flight stream tube was very long (drawback: very high installations with concomitant expense and possible space problems).

A single-stage flight stream tube has been proposed which avoids these problems, in that the coarser coal fractions are temporarily separated from the gas stream and from the finer fractions during movement through the tube, and are then readmitted into the gas stream. This causes the coarser particles to undergo renewed acceleration and improves heat exchange between them and the gas stream as well as the finer particles. While this apparatus and the method practiced with it are valuable improvements over the art prior thereto, still further improvements nevertheless are found to be desirable.

SUMMARY OF THE INVENTION

Accordingly, it is an object of the invention to provide such further improvements.

A more particular object of the invention is to provide an improved method of drying and preheating particulate coking coal in a flight stream tube.

Another object is to provide an improved apparatus for carrying out the method, which apparatus is to have lesser susceptibility to wear in operation.

In keeping with these objects, and with still others which will become apparent hereafter, one aspect of the invention resides in the inventive method. Briefly stated, this may comprise the steps of advancing a stream composed of hot gas and mixed fractions of moist coal particles upwardly through a flight stream tube in a primary path; temporarily diverting the coarser particle fractions from the stream into a secondary path; and thereupon readmitting the coarser particle fractions from the secondary path into the primary path in a direction generally opposite to the advancement of the stream.

Another important aspect of the invention resides in the inventive apparatus which may comprise an upright flight stream tube having a lower portion, an upper portion, and an intermediate portion bounded by a wall diverging from a central longitudinal axis of the lower position, so that a stream of gas and smaller fractions entrained therein is diverted from the lower portion into the intermediate portion whereas the coarser fractions continue to travel lengthwise of the axis; and means for returning the coarser fractions into the stream of gas and smaller fractions, comprising a tube section positioned to receive the coarser fractions and to discharge them back into the stream at least substantially in direction counter to the advancement of the stream.

Heat exchange in the flight stream tube is the more rapid, the higher the relative speed of the individual coal particles and the carrier gas. In the prior art this was achieved by segregating the coarser particles, braking their speed and readmitting them into the stream of gas and fine particles, for reacceleration thereby. The coarser particles come to a complete or almost complete halt before they are readmitted into the stream of gas and fine particles. At the time this occurs the particles are still moist, and this may lead to the formation of agglomerations and possibly even blockages of the passage leading back into the main stream. Also, the still extant moisture is a source of strong corrosive activity, with consequent wear of the apparatus parts.

Surprisingly, it has been found that these problems can be overcome by proceeding in accordance with the present invention, i.e., by dividing the flow in the flight stream tube at one or more locations into two respective partial streams. The larger of these partial streams is deflected from its original direction of movement whereas the smaller partial stream initially continues to move in the old (i.e., original) direction. The smaller coal particle fractions of course have a lower inertia than the coarser fractions; consequently, the deflected larger partial stream is able to take them along, i.e., to deflect them out of their initial path. The higher-inertia larger fractions continue to travel in the smaller partial stream. If, according to the invention, they are subsequently readmitted into the larger partial stream in direction opposite or substantially opposite to the advancement of the same, then the coarser fractions must be deflected by the larger partial stream through almost 180° in the process of being re-entrained. They therefore undergo a renewed acceleration with the concomitant desirable results mentioned earlier.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
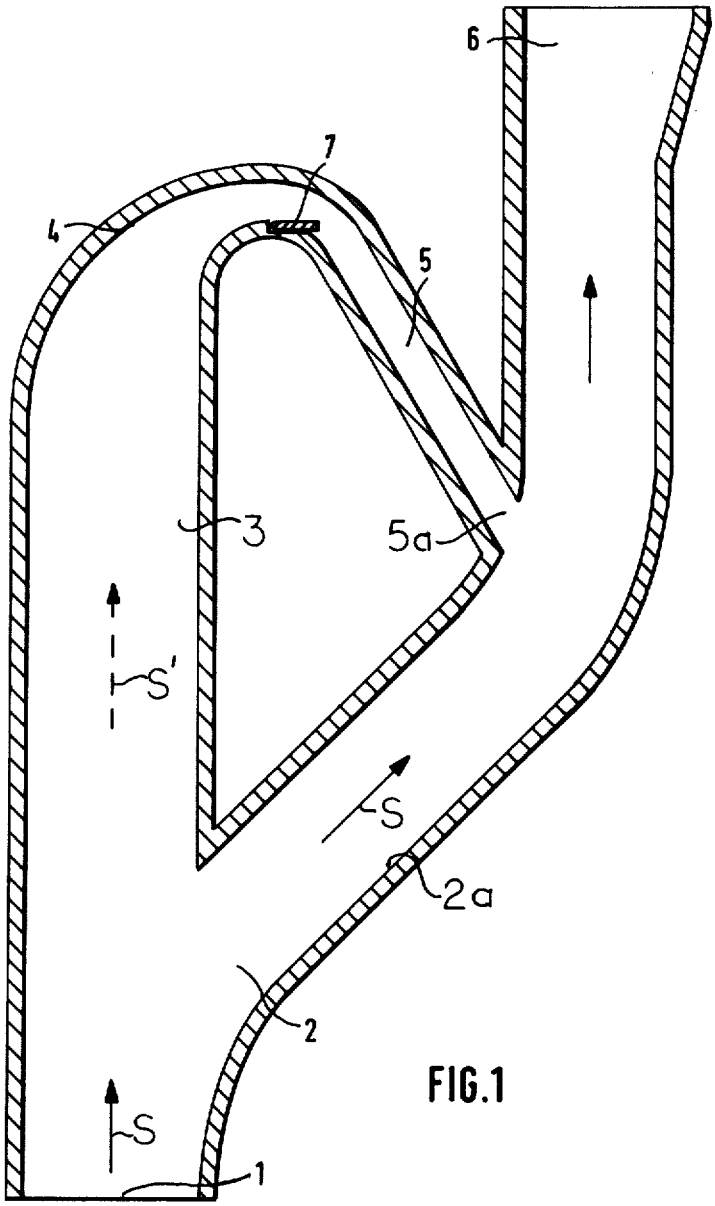
FIG. 1 is a diagrammatic fragmentary vertical longitudinal section through a flight stream tube incorporating one embodiment of the invention.

In FIG. 1 a stream S of hot carrier gas and therein entrained larger and smaller fractions of particulate coking coal, is admitted into the lower end region 1 of an upright (usually vertical) flight stream tube, for advancement towards its upper end region 6. The source of coal and carrier gas, and the manner of admission, are all known per se.

As the stream S advances upwardly at high speed it encounters a branch 2 of the flight stream tube. Since it tends to cling to and follow the curved surface 2*a*, the stream S undergoes a sudden change in direction as it enters into the branch 2. The lighter particle fractions have lower inertia and are able to follow this sudden deflection of the stream S; the higher-inertia coarser particles cannot do so and continue to travel in their initial direction, together with a split-off secondary gas stream S'.

The stream S' travels through a straight tube section 3 and is then deflected via an elbow 4 into a reversed tube section 5, the outlet 5*a* of which faces completely (or, as shown, generally) opposite to the direction of advancement of stream S. The cross-section of tube section 3 is reduced as it merges into elbow 4. The weight of the coarser particles, their friction with the inner surfaces of elbow 4 and the throttling of stream S' due to the reduction in cross-section, all combine to effect a substantial reduction in the speed of the coarser particles. This, combined with their direction of movement opposite to the stream S as they enter the latter via outlet 5*a*, causes the coarser particles to undergo a renewed acceleration as stream S' re-unites with stream S to travel to the outlet region 6 of the flight stream tube. During this acceleration phase the coarser particles have the desired high speed relative to the gas stream (or vice versa), so that an improved heat transfer takes place.

One or more throttle flaps (one shown) 7 may be provided to vary the cross-section of elbow 4 at will. If, as illustrated, such a flap is provided on the inner side of the elbow curvature, there is no interference between it and the stream of coal particles which slide along the inner surface of the elbow at the outer side of the curvature thereof under the influence of centrifugal acceleration. On the other hand, however, the flap 7 offers sufficient resistance to the flow of the carrier gas in stream S', so that a variation of this resistance can be used to determine the particle size of the coarser fractions which are separated by the device from the finer fractions in stream S. That is to say that the stronger the flow of stream S' through elbow 4 is throttled, the lower the proportion of small particle fractions which enter the bypass 2 with stream S. It follows that the throttle 7 can be used to reduce the gas stream S' to a minimum, if desired, while mechanical strains on the particles (e.g., abrasion and the like) are largely avoided.

Figure 2:
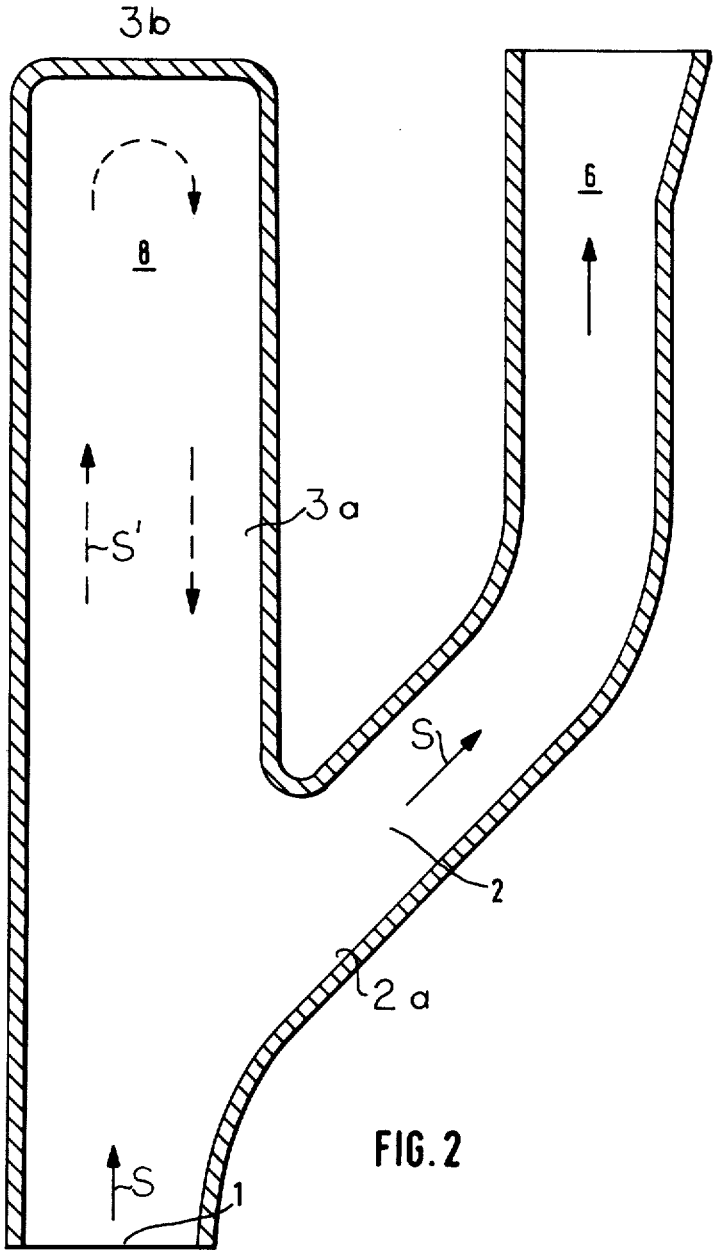
FIG. 2 is a view analogous to FIG. 1 but of a different second embodiment.

In the embodiment of FIG. 2, like reference numerals have been used to designate like elements as in FIG. 1. The gas/particle stream S is suddenly deflected into the bypass 2 as before. The tube 3*a*, however, is closed at its end 3*b* remote from the junction of tube 3*a* with flight stream tube portion 1. The split-off smaller gas stream S' with its coarser particle fractions enters the tube 3*a* and forms eddies in the region 8 adjacent the closed end 3*b*, so that the particles are either braked or impact the end 3*b* with some residual speed. Thereupon they drop back to the junction with section 1 and branch 2 in free fall, to be entrained and accelerated by the stream S as the same is diverted into branch 2.

Figure 3:
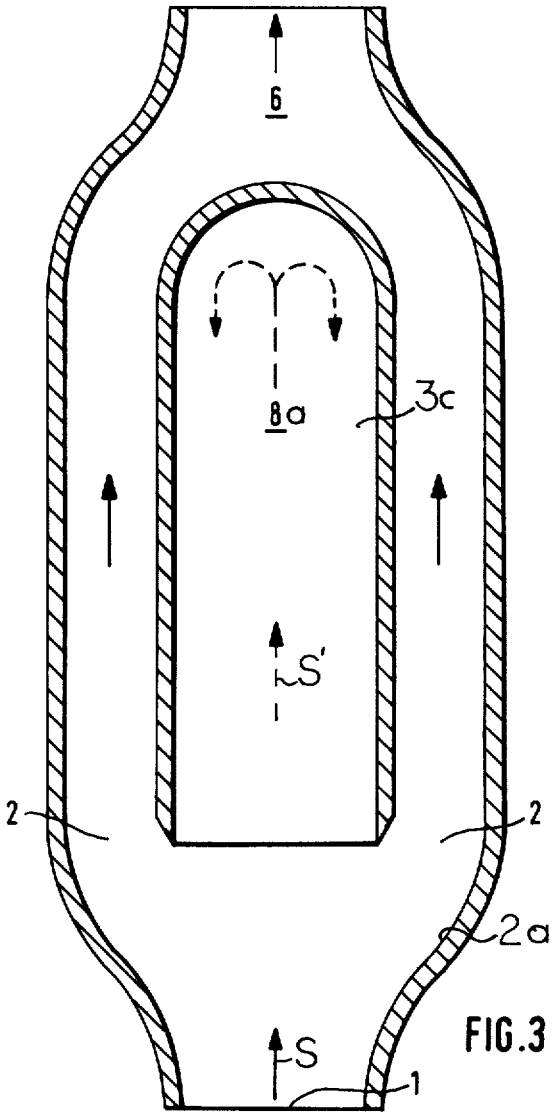
FIG. 3 is another view analogous to FIG. 1 but showing still a third embodiment of the invention.

The embodiment of FIG. 3 is essentially similar to that of FIG. 2, except that here the tube 3*c* (corresponding to tube 3*a*) is suitably mounted at the center of the enlarged-diameter branch section 2 of the flight stream tube, with its open end facing towards and coaxial with the tube section 1. The operation is the same as in FIG. 2, except that stream S is deflected in form of an annular jacket about the tube 3*c*.

The downstream end of the tubes 3*a*, 3*c* is closed in both FIG. 2 and FIG. 3, unlike the embodiment of FIG. 1. However, the same effect can be obtained in FIG. 1 also, by simply closing the throttling flap 7 completely. Overall, the best results are obtained if the coarser fractions are readmitted into the carrier gas and lighter fractions in such a manner that the coarser fractions are dropping vertically or near-vertically before they reenter the gas/particle stream; the then following acceleration is most intense under these conditions. The eddy formation in the embodiments of FIGS. 2 and 3 is most pronounced if the cross-section of the tube 3*a* or 3*c* is greater than that of the branch 2, or even of the entire remainder of the flight stream tube per se. Also of particular advantage is a reduction in the cross-section of branch 2 by comparison to the flight stream tube cross-section before and after the branch 2, so that the old cross-section is reached only after the two partial streams S, S' have become reunited.

Comparisons were made between a flight stream tube having a length of 30 m and a diameter of 0.45 m and provided at mid-height with the embodiment of FIG. 1, and an otherwise identical prior-art flight stream tube without the FIG. 1 embodiment. The tubes were operated at identical conditions, namely with a carrier gas stream of 4.75 $m^3$/sec., carrier gas speed of 30 m/sec. and a coal particle throughput of 2.8 Kg/sec. with a particle size unit of 0–6 mm. The following results were obtained:

| | Tube incorporating FIG. 1 | Tube without FIG. 1 |
|---|---|---|
| Mean coal particle dwell time in tube | 4.33 sec. | 2.03 sec. |
| Temp. diff. between coal and carrier gas at 200° C. coal temp. on exit from upper tube end | 55 K. | 95 K. |

These test results show clearly that in the flight stream tube incorporating the present invention the coal particle dwell time in the flight stream tube was increased substantially. This results in a better heat exchange between carrier gas and coal particles, a fact which is confirmed by the reduction of the temperature difference between them, so that the carrier gas enthalpy is used to greater advantage. The heat carrier gas can be operated at lower incoming (and consequently at lower outgoing) temperatures, with a resulting reduction of heat energy losses from the carrier gas which is vented to atmosphere after separation from the dried and preheated coal particles.

While the invention has been illustrated and described as embodied in the drying and preheating of coal particles for coke production, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constituted essential characteristics of the generic or specific aspects of this invention.

What is claimed as new and desired to be protected by Letters Patent is set forth in the appended claims:

1. Method of drying and preheating coking coal fines composed of mixed particle fractions in an upright flight stream tube, comprising the steps of advancing a stream composed of hot gas and mixed fractions of moist coal particles upwardly through a flight stream tube in a primary path; temporarily splitting said stream into a larger main stream containing the smaller particle fractions and a smaller secondary stream containing the coarser particle fractions; thereupon admitting the coarser particle fractions into the main stream with the smaller particle fractions in a directions generally opposite to the advancement of the main stream; and varying the volumetric quantity of said secondary stream to thereby vary the size composition of the coarser particle fractions contained therein.

2. Apparatus for drying and preheating coking coal fines composed of mixed particle fractions, comprising an upright flight stream tube having a lower portion, an upper portion, and an intermediate portion bounded by a wall diverging from a central longitudinal axis of said lower portion, so that a larger main stream of gas with smaller fractions entrained therein is diverted from said lower portion into said intermediate portion whereas a secondary stream with coarser fractions continue to travel lengthwise of said axis; and means for returning said coarser fractions into the main stream of gas with smaller fractions, comprising a tube section positioned to receive said coarser fractions and to discharge them into said main stream at least substantially in direction counter to the advancement of the main stream.

3. Apparatus as defined in claim 2, said tube section having a straight part coaxial and communicating with said lower portion and having a downstream closed end.

4. Apparatus as defined in claim 2, said tube section having an opening through which the coarser particle fractions reenter into said stream of gas and of the smaller particle fractions, said opening facing at least substantially opposite to the direction of advancement of said main stream.

5. Apparatus for drying and preheating coking coal fines composed of mixed particle fractions, comprising an upright flight stream tube having a lower portion, an upper portion, and an intermediate portion bounded by a wall diverging from a central longitudinal axis of said lower portion, so that a larger warm stream of gas with smaller fractions entrained therein is diverted from said lower portion into said intermediate portion whereas a secondary stream with coarser fractions continue to travel lengthwise of said axis; and means for returning said coarser fractions into the main stream of gas with smaller fractions, comprising a tube section positioned to receive said coarser fractions and to discharge them into said main stream at least substantially in direction counter to the advancement of the main stream, said tube section having an upstream straight part coaxial and communicating with said lower portion, and a downstream curved part which connects said upstream straight part with said intermediate portion and which has an outlet discharging into said intermediate portion in direction counter to the advancement of said stream therein, said tube section having an upstream straight part coaxial and communicating with said lower portion, and a downstream curved part which connects said upstream straight part with said intermediate portion and which has an outlet discharging into said intermediate portion in direction counter to the advancement of said stream therein.

6. Apparatus as defined in claim 5, said upstream straight part having a cross-section larger than that of said intermediate portion.

7. Apparatus as defined in claim 5, said intermediate portion having between said lower portion and said outlet a cross-section which is smaller than that of said lower portion, and having downstream of said outlet a cross-section which is equal to that of said lower portion.

8. Method of drying and preheating coking coal fines composed of mixed particle fractions in an upright flight stream tube, comprising the steps of advancing a stream composed of hot gas and mixed fractions of moist coal particles upwardly through a flight stream tube in a primary path; temporarily splitting said stream into a larger main stream containing the smaller particle fractions and a smaller secondary stream containing the coarser particle fractions; and thereupon admitting the coarser particle fractions into the main stream with the smaller particle fractions in a direction generally opposite to the advancement of said main stream.

9. Method as defined in claim 1, wherein the step of temporarily diverting comprises splitting said stream into a larger main stream containing the smaller particle fractions and a smaller secondary stream containing the coarser particle fractions.

10. Method as defined in claim 9, wherein the secondary stream is caused to undergo eddying.

11. Method as defined in claim 9, wherein the step of readmitting comprises admitting said secondary stream into said primary stream downwardly in a direction at least substantially opposite to the direction of advancement of said primary stream.

12. Apparatus as defined in claim 8, said tube section including means for throttling the flow of gas and entrained particles therethrough.

* * * * *